United States Patent [19]

Tomberlin

[11] Patent Number: 5,066,258

[45] Date of Patent: Nov. 19, 1991

[54] RETURNING FLYING TOY

[76] Inventor: Rand K. Tomberlin, 4017 N. Bennington, Apt. 104, Kansas City, Mo. 64117

[21] Appl. No.: 638,186

[22] Filed: Jan. 7, 1991

[51] Int. Cl.[5] ..... A63H 33/18

[52] U.S. Cl. ..... 446/40; 446/46; 273/424

[58] Field of Search ..... 446/34, 36, 37, 40, 446/42, 46, 47, 48; 273/424, 425

[56] References Cited

U.S. PATENT DOCUMENTS

| | | | |
|---|---|---|---|
| Des. 221,453 | 8/1971 | Swanberg | 273/425 X |
| 466,172 | 12/1891 | Leeb | 446/42 |
| 804,972 | 11/1905 | Pioch | 446/42 |
| 3,246,424 | 4/1966 | Gregory | 446/40 |
| 3,802,117 | 3/1967 | Engelhardt | 446/46 |
| 3,935,663 | 2/1976 | Leibowitz | 446/48 |
| 4,182,073 | 1/1980 | Tabet | 446/46 |
| 4,752,267 | 6/1988 | Layman | 446/46 |

*Primary Examiner*—Robert A. Hafer
*Assistant Examiner*—Sam Rimell
*Attorney, Agent, or Firm*—Kokjer, Kircher, Bradley, Wharton, Bowman & Johnson

[57] ABSTRACT

A flying amusement device including first and second rotary elements separated by a hub. Each of the rotary elements includes a set of lift members which provide lift in a common direction when the device is rotated about the hub. A length of flexible line is connected to the hub and wound thereabout prior to use. The device is held in the user's hand with the free end of the flexible line connected to the user's throwing hand. The device is then thrown outwardly from the body of the user with a snapping motion of the wrist to impart rotation to the device. This rotation produces lift, and further rotation is imparted to the device due to the device unwinding from the flexible line as it travels away from the user. Upon fully unwinding the flexible line from the hub, the continued rotation of the device causes the flexible line to be rewound upon the hub, thus drawing the device back towards the user. During the travel of the device away from and towards the user, the continued rotation of the device produces lift which causes the device to fly through the air.

20 Claims, 1 Drawing Sheet

RETURNING FLYING TOY

BACKGROUND OF THE INVENTION

1. Field of the Invention

The present invention relates in general to flying amusement devices. In particular, it relates to an improved amusement device capable of flight yet which returns to the user.

2. Description of the Related Art

Flying amusement devices or toys have long been popular. A particularly popular flying amusement device is an aerodynamic flying disk (e.g. Frisbee®). Such disks are held in the user's hand and thrown forward while effecting a snapping motion with the wrist to impart rotation to the disk. This rotation reduces subsequent tilting of the disk out of the plane occupied when leaving the user's hand, and the forward motion of the disk induces lift therein. While flying disks provide an easily produced and controlled flight, it is often necessary to have at least two users for their enjoyment. While it is possible to throw a flying disk upward at an angle and have the disk return to the thrower, this is often less enjoyable than the skimming flight path of a flying disk thrown near level.

In an effort to overcome the need for at least two players with a flying disk, U.S. Pat. No. 3,802,117 to Engelhardt discloses a flying disk which is tethered. The flying disk includes a reel extending downwardly from the center thereof. A flexible line is connected to and wound upon this reel, with the free end of the flexible line being attached to a casting wand. While such an arrangement allows a single user to enjoy a flying disk, the use of the casting wand makes it very difficult to grasp the flying disk properly to throw or catch the disk.

Additionally, the reel extending below the lower edge of the flying disk is subject to forces from the flexible line extending between the reel and the wand. This will tend to tilt the flying disk during its flight, typically causing the disk to dive, thus reducing the possible flight length. While Engelhardt proposes to correct this by adding a weight to the lower end of the reel, this increased weight will in itself reduce the possible flight length. Finally, the line must be rewound before each use to ensure it unwinds correctly during throwing.

SUMMARY OF THE INVENTION

It is an object of the present invention to provide a flying amusement device.

It is a further object of the present invention to provide a flying amusement device which may be used by a single individual, and will automatically return to the user.

It is another object of the invention to provide a flying amusement device for a single user which may be reused rapidly and easily.

It is a further object of the invention to provide a flying amusement device with improved lift characteristics.

These and other objects are achieved by the provision of a flying amusement device having first and second rotary elements connected by a central hub. The rotary elements include lift producing members such that throwing the device with a spinning motion will cause the device to fly through the air. A flexible line is connected to the hub and is wound thereabout prior to operation by the user. The free end of the flexible line is retained by the user when the object is thrown.

In this manner, additional rotation will be imposed upon the device by the flexible line unwinding from the hub during travel away from the user. This rotation will cause the lift members to produce aerodynamic lift, thus maintaining the flight of the device. Upon reaching the end of the flexible line, the continued rotation of the device will cause the flexible line to be rewound upon the hub. As the flexible line winds about the hub, the device is automatically drawn towards the user.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
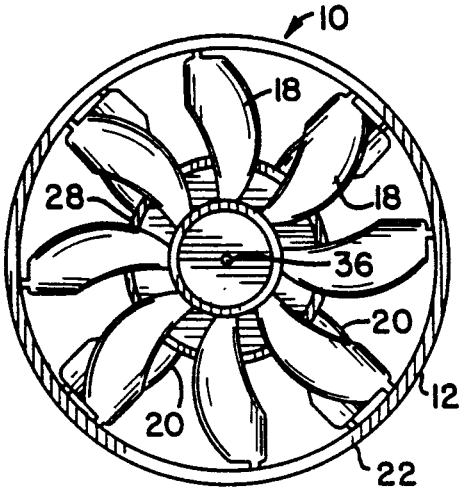
FIG. 1 is a top view of a first embodiment of the device according to the present invention.
Figure 2:
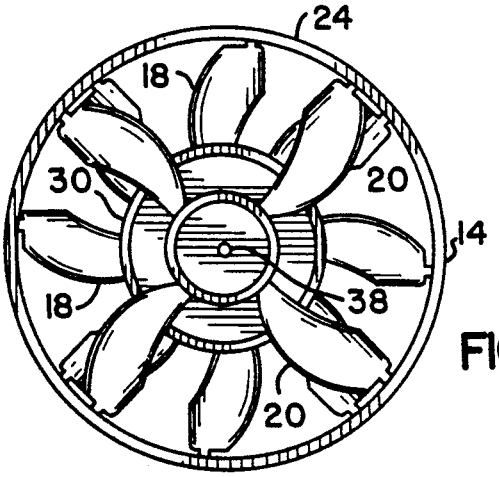
FIG. 2 is a bottom view of the device of FIG. 1.
Figure 3:
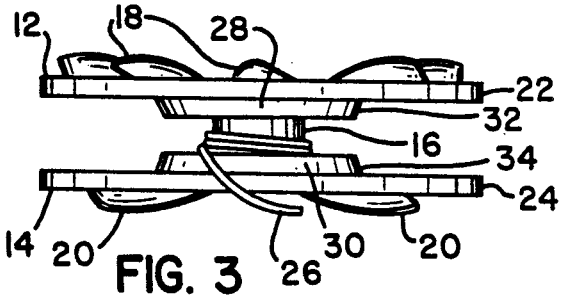
FIG. 3 is a side view of the device of FIG. 1.
Figure 6:
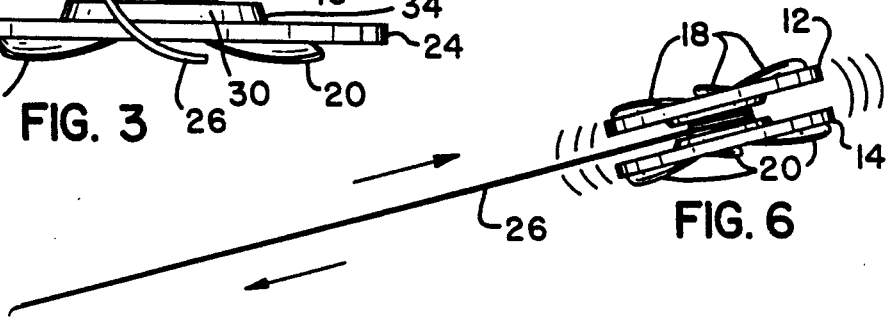
FIG. 6 is a diagram illustrating operation of the present device.

With reference to FIGS. 1–3, the amusement device of the present invention is generally designated by reference numeral 10. The device includes first and second rotary elements 12, 14, respectively. Rotary elements 12 and 14 are adapted for rotation about a central longitudinal axis of each of the elements. Rotary elements 12 and 14 are held in a spaced substantially parallel opposing position by a hub 16. The hub 16 extends between the rotary elements at the central rotation axis of the elements.

As shown in FIG. 1, first rotary element 12 includes a plurality of members 18 extending outwardly from the axis of rotation. A set of second members 20 extend outwardly from the central rotation axis of the second rotary element 14. Each of the rotary elements also includes an edge guard extending between, and connected to, the outer ends of the associated set of members 18 and 22. In particular, first rotary element 12 includes a first edge guard 22 and second rotary element 14 includes a second edge guard 24.

Each of the set of members may extend radially outwardly from the central rotation axis of the associated rotary element. At least some of the members extend radially outwardly and are designed to produce aerodynamic lift when the device is rotated about the hub 16, and these members may be designated as lift members.

The lift members may of course take many forms to provide such lift. In their simplest form, the lift members may simply be planar members tilted about the radial axis along which each member extends. The lift members could alternatively take the form of air foils and have a cross-sectional shape similar to that of an airplane wing. Additionally, with either arrangement the circumferential width of the members may vary radially of the device, as shown in FIGS. 1 and 2. As also shown in FIGS. 1 and 2, the leading and trailing edges of the members need not be straight, but may have curved or other complex configurations.

In particular, as shown in FIGS. 1 and 2, the lift members 18 and 20 may have a curved leading edge and a trailing edge which is partially curved and partially rectilinear. The lift members 18 and 20 may of course have their configurations optimized to create the maximum lift during rotation thereof. For example, their cross-sectional configuration, radial length and attack angle may all be varied.

During rotation of the device 10, the first and second lift members will rotate with the device, thus imparting a forward motion to each of the lift members with respect to the surrounding air. As is well known, such motion of the types of lift members described above will cause each lift member to provide an upward force with respect to the surrounding air. In particular, where the lift members are tilted planar members, the movement of the lift members will force the impinging air downwardly with respect to such lift members. This will translate into a lifting of the planar members.

Where the lift members are formed as air foils, the members will act as do airplane wings, producing a negative pressure area above the body of the lift member and a downwash of air from the trailing edge of the member. These two forces will combine to provide a lift from the air foil type lift member.

While these effects may be readily envisioned to provide lift for the device 10 from each of the sets of lift members, the relative proximity of the two sets of lift members may result in the same effects caused by one set of lift members having a degrading effect upon the lift produced by the other set of lift members.

In particular, as shown in FIG. 3, with the first set of lift members 18 being uppermost, rotation of the device 10 about the center axis will cause each of the sets of lift members to produce the effects which cause lift. As such, the first lift members 18 will provide a downwash of air from the first rotary element 12. This downwash of air may impinge upon the second set of lift members 20. While the second set of lift members 20 will still provide lift with respect to the air impinging upon them, where this impinging air includes an initial downdraft, the lift produced by the second set of lift members may be at least partially canceled out by the force of the downwardly moving air, resulting in no net gain in lift from the lower second set of lift members 20.

In addition, where the lift members are formed as air foils, the lower second set of lift members will produce an area of negative pressure above each of the lift members. This negative pressure may reduce the effectiveness of the downwash of air leaving the trailing edge of the upper first set of lift members 18, thus reducing the amount of lift produced by the upper first set of lift members.

Several means are available to reduce such undesirable interaction between the two sets of lift members. The hub 16 could of course be elongated such that the rotary elements, and thus the lift members, are separated by a greater distance. While this would reduce the impact of lift effects from one set of lift members upon the other set, this would also increase the overall size of the device. As such, where the overall size of the device is to be limited, other methods are required.

A simple and preferred means for limiting the impact of one set of lift members upon the others is to provide fewer lift members in one set of lift members than in the other set. This is clearly shown by comparison of FIGS. 1 and 2.

In particular, FIG. 1 shows first lift members 18 comprising a set of eight individual lift members. In contrast, FIG. 2 shows that only four individual second lift members 20 are provided. In this manner, when the first lift members 18 are uppermost, any negative air pressure areas produced by the lower set of lift members 20 is reduced due to the reduction in number of second lift members 20. Additionally, the downward flow of air from the upper lift members 18 is less impeded by the reduced number of lower lift members 20. In effect, the reduced number of second lift members 20 provides venting which is believed to be quite important for the maximum production of lift in the device 10.

Furthermore, as noted above, not all of the members need be lift members. For example, a few of the first lift members 18 and/or some or all of the second members 20 may be formed merely as radial braces having no lift producing configuration. This would reduce the negative effects of members 20 on the lift production of upper lift members 18. Even in this situation, however, it is best if the lower members 20 have only a small area to allow the venting discussed above.

When the device 10 is used in the orientation opposite that shown in FIG. 3, i.e., with second lift members 20 uppermost, desirable results are also achieved. Specifically, there is a reduced downwash of air from the upper lift members 20 due to their reduced number. The lowermost lift members 18 thus perform quite effectively, and the downwash of air from the more numerous lift members 18 has little impact on the uppermost lift members 20.

While the greater number of lower lift members 18 will result in a larger number of reduced pressure areas thereabove, this appears to have little effect upon the lift capabilities of the uppermost lift members 20. It may also be possible to reduce these effects further. While each set of lift members is preferably distributed radially symmetrically about each associated rotary element, the circumferential location of one set of lift members relative to the other set of lift members may be adjusted to reduce such effects even further.

Figure 4:
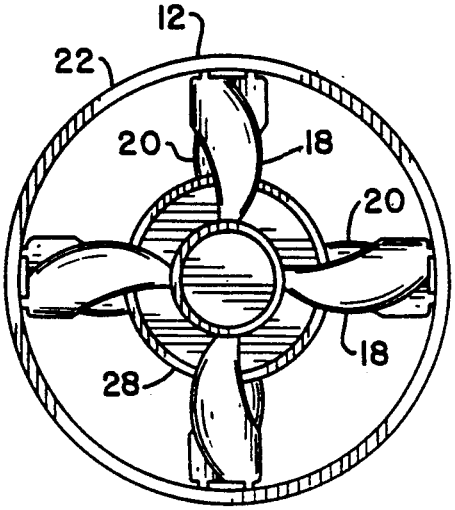
FIG. 4 is a top view of a second embodiment of the device of the present invention.
Figure 5:
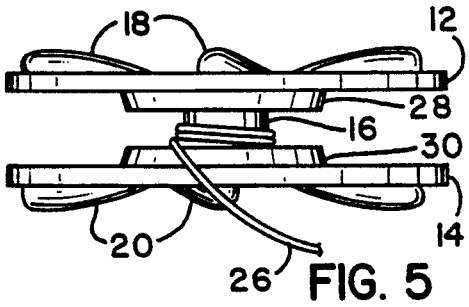
FIG. 5 is a side view of the device of FIG. 4.

A second embodiment of the present invention is shown in FIGS. 4 and 5. This embodiment is similar to that discussed above, and includes a first rotary element 12, second rotary element 14, hub 16, plural first and second lift members 18, 20 and first and second edge guards 22, 24.

The main difference between this second embodiment and that discussed above is the number of lift members provided. Whereas the first embodiment provided a relatively large number of first lift members with fewer second lift members 20, in this second embodiment a relatively small number of lift members are provided, with this number being equal for both the first and second set of lift members.

As is shown in FIG. 4, four first lift members 18 and four second lift members 20 are provided on each of the first and second rotary elements, respectively. Each first lift member 18 is also circumferentially aligned with an associated second lift member 20. It should of course be clear that, while each set of lift members is preferably radially symmetrically located on the associated rotary element, the lift members may be circumferentially offset between the two sets of lift members.

As shown in FIGS. 3 and 5, a length of flexible line 26 is connected to the hub 16 of the device 10. A first end of the flexible line is connected to the hub 16. This connection of the first end of flexible line 26 to the hub may be a fixed connection, as by adhesively or thermally bonding the first end of the line 26 to the hub 16.

The first end of the flexible line 26 may also be rotatably connected to the hub 16. For example, the first end of line 26 could be wrapped about the hub 16 and then attached to itself, creating a loop about the hub 16. Alternatively, the first end of flexible line 26 could be fixedly connected to hub 16, with hub 16 including a centrifugal clutch such that the hub 16 is fixed with respect to the device 10 below a predetermined rate of rotation, but is freely rotatable with respect to the device 10 above such predetermined rate of rotation. Such a centrifugal clutch is shown in U.S. Pat. No. 4,332,102 to Caffrey, which is included herein by reference.

Where the first end of line 26 is rotatably connected to the hub 16, it is important that the connection still allow the line 26 to be wound upon the hub 16, as will be apparent from the discussion of the operation of the device below. The rotary elements themselves will, to a certain extent, guide the line to the proper winding position. However, if the lift members extend too far inwardly of the rotary elements the line may become fouled on the lift members.

In order to reduce fouling of the flexible line 26 in lift members 18 and 20 during rotation of the device 10, and to assist in winding the flexible line about the hub 16, the device 10 may be provided with a pair of line guides 28, 30. The first line guide 28 extends radially outwardly from the hub 16 and is located adjacent the first rotary element 12. Similarly, second line guide 30 extends radially outwardly from the hub 16 and is located adjacent the second rotary member 14.

The outer peripheral edges of the line guides 28 and 30 may be tapered inwardly towards the center of the device to form inclined surfaces 32 and 34 on the first line guide 28 and second line guide 30, respectively. Such inclined surfaces will tend to guide the flexible line 26 inwardly of the device 10 away from the rotary elements 12 and 14, and thus assist in winding of the flexible line upon the hub 16.

In use of the device, the user holds the device 10 in one hand while winding the flexible line 26 about the hub 16 with the other hand. When the winding of line 16 has been substantially completed, the user connects the free second end of line 26 to the hand which will be used to throw the device 10. The connection of the second end of line 26 to the user's hand should be a stable fixed connection. It has been found advantageous to form a loop in the second end of line 26 and to engage the middle finger of the user's throwing hand with this loop.

Any slack in flexible line 26 is taken up at this point by continued winding of the line 26 about the hub 16 until the device 10 may be held in the throwing hand with the flexible line substantially taut between the connection to the user's hand and the hub 16.

To throw the device 10, the device is held such that the rotational axis of the device is substantially vertical. While holding the device 10 near the palm of the throwing hand, the throwing hand is curled inwardly towards the user's body. The user then throws the device 10 outwardly from the body while simultaneously effecting a snapping motion with the wrist to impart a rotational force to the device 10. From this description, it should be apparent that the device 10 should be held with the appropriate rotary element upward such that the rotation imparted during the release of the device corresponds to the direction in which the flexible line 26 was wound upon hub 16.

As the device 10 travels away from the user, it is noted that the flexible line 26 extends between the user's throwing hand and the hub 16 of the device 10. To continue forward movement the device 10 thus induces rotation therein as the flexible line 26 is unwound from the hub 16. This continued rotational force imposed upon the device 10 augments and amplifies the initial rotary motion imposed by the snapping of the user's wrist. The rotation of device 10 is very important, since the only lift produced by the device 10 is that of the lift members 18 and 20 during rotation of the device.

As the device 10 continues outward from the user, the flexible line 26 remains taut between the user and the device, and the flexible line continues to be unwound from the hub 16. As the line continues to unwind, successive layers of wound line 26 are removed from the hub 16. As such, the portion of the line extending between the user and the hub 16 grows closer and closer to the outer periphery of hub 16 and thus the axis of rotation of device 10. This constant decrease in the outer diameter of the wound portion of line 26 means that for each unit length of line 26 unwound from the hub 16, a larger number of rotations of the hub 16, and thus device 10, are necessary to unwind such a length of line. Therefore, the rotational speed of the device 10 can actually increase as it moves away from the user.

This increase in rotational speed translates directly into an increase in lift produced by the lift members. As such, the lift produced by the device 10 is at its greatest when the entire length of flexible line 26 is finally unwound from the device 10.

Upon completely unwinding the length of flexible line 26, the device 10 is at its maximum distance from the user and possesses a rotation due to the unwinding of the line 26. Since the line 26 has been completely unwound, the line will grow taut between the user's hand and the hub 16 and stop the outward motion of the device 10 from the user. The rotation imparted during the unwinding, however, remains.

Where the first end of line 26 is fixedly connected to the hub 16, the continued rotation of device 10 will cause the line 26 to be wound upon the hub 16, and thus pull the device 10 back towards the user.

Where the first end of flexible line 26 is rotatably connected to the hub 16, the continued rotation of the device 10 will not automatically rewind the line on the hub. However, upon the line 26 stopping the outward motion of the device 10, the device 10 will rebound slightly towards the user. This will create a slackness within the flexible line extending from the user's hand to the device 10.

Friction between the rotatable connection of the flexible o line and hub will then be greater than the force necessary to wind the flexible line about the hub 16. As such, a small portion of the line will be wound about the hub, creating more friction between the flexible line and hub. This will, in turn, allow more of the line to be wound about the hub, creating more friction, with this process continuing until there is sufficient friction within the rotatable connection to cause the flexible line 26 to be wound upon the hub 16 even when the line extending between the user's hand and the device 10 is taut. The device 10 will thus return towards the user as with the case where the first end of the flexible line is fixedly connected to the hub 16.

The rotational speed of the device 10 will begin to slow somewhat due to the torque exerted by the winding of the line about the hub 16. However, it has been found that sufficient rotational speed will be maintained to create sufficient lift such that the device will remain in flight during the entire return to the user's hand. When the device 10 continues winding the line about the hub 16, it automatically returns along the length of the line 26, and thus towards the user's throwing hand which has the second free end of line 26 connected thereto. The user need merely open the hand to catch the device 10 as it returns.

As can be seen from the above, this arrangement provides a flying amusement device which may be enjoyed by a single user.

Although less apparent, it is noted that the winding of the line about the hub 16 during the return of the device to the user is in the opposite direction than that necessary for reuse of the device. However, the symmetrical nature of the present device presents an easy solution.

By simply rotating the device 180 degrees, such that the rotary member which was previously uppermost will be lowermost, the direction of winding of the line 26 about the hub 16 is correct for reuse of the device. As such, the user may throw the device again with only minimal preparation necessary.

It is noted in this regard that if the device is repeatedly used in this fashion, the leading edge, with respect to the direction of rotation, of each of the lift members will alternate with each use. As such, the lift members should be designed to produce lift no matter which of the edges is leading.

Additionally, to aid the user in quickly ascertaining whether the device is ready for throwing, the two rotary elements may be of different colors, preferably contrasting, such that it is readily apparent that the device has been turned over since the previous throw.

While the device 10 could of course be formed in any size desired, it has been found particularly advantageous to form the device 10 such that the user's hand may encompass approximately half of the periphery of the device. This allows the user to easily hold the device steady in one hand in preparation for throwing. With this size of device, it has also been found advantageous to space the rotary elements longitudinally along the axis of rotation of the device by a distance slightly smaller than the width of the user's finger. In this manner the finger to which the second free end of the line 26 is connected may be rested between the rotary elements to improve control during the throwing of the device.

A device of the present invention could of course be formed by numerous different methods. The device could be formed as a monolithic unit, or could be several assembled elements. In particular, the rotary elements 12 and 14 could be connected to the hub 16 by the use of pins 36 and 38. Such pins could connect these noted elements by an interference fit, or by the use of an adhesive or thermal bond. A single pin could also be substituted for the two pins 36 and 38.

The materials used to form the device may also vary widely. Lightweight plastic is the preferred material, although ceramics and metals are of course feasible. In addition, rugged yet pliable foamed plastics may also be employed to ensure that the device is safe for indoor use.

The device need not be made of a single material. For example, the hub and lift members could be formed of a lightweight plastic, with the edge guards 22, 24 being formed of a denser plastic, ceramic or metal. Such higher density materials near the outer edges of the device would improve the moment of inertia, and thus the rotational characteristics, of the device. The moment of inertia could also be increased by forming the edge guards of the same material as the lift members, but by increasing the size of the edge guards.

It is also noted that the edge guards need not be circular as shown in the accompanying drawings. While this circular configuration is preferred to improve the catchability of the device, other peripheral configurations, including hexagonal and octagonal, are possible.

Other variations in the device are also possible. The device as shown in the drawings shows the lift members having a configuration to produce lift when thrown as described from a right-handed user. The members could obviously be oriented in the opposite direction to accommodate left-handed users. The members need not extend radially outwardly, and the second set of members 20 could be formed merely as structural braces for the second element.

In this regard it is noted that the second members 20 could be deleted entirely. While it is preferred that the second element not be eliminated, and that it have a size substantially equal to that of the first element, the second element could be formed as a solid disk. However, since the venting of the first lift members is considered important, the second element could include holes, perforations or other openings allowing this venting. Such openings should, of course, cover a sufficient percentage of the surface area of the disk to allow venting.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A returning flying toy, comprising:

first and second rotary elements, each of said elements having a longitudinal axis and being adapted for rotation about said axes, at least said first rotary element including a plurality of first members extending outwardly from said longitudinal axis of said first rotary element, at least a portion of said plurality of first members being capable of producing aerodynamic lift in a direction substantially parallel to said longitudinal axis of said first element when said first element is rotated about its said longitudinal axis;

a hub extending between said rotary elements and coupling said elements in spaced opposed relation with said axes substantially coincident, said hub being substantially coaxial to said axes of said elements; and a length of flexible line, a first end of said line being coupled to said hub, and said line being adapted to be wound upon, and unwound from, said hub.

2. A toy as in claim 1, wherein all of said first members extend radially outwardly from said axis and are capable of producing said aerodynamic lift upon said rotation.

3. A toy as in claim 2, wherein said second rotary element includes a plurality of second elements extending outwardly from said axis and wherein the number of said first members is greater than the number of said second members, whereby said second members provide venting to avoid fluid flow interference with said aerodynamic lift produced by said first members.

4. A toy as in claim 1, wherein said portion of said first members are capable of producing aerodynamic lift substantially parallel to said axes upon rotation of said elements, said lift being produced in opposite directions upon opposite rotation of said elements 5. A toy as in claim 4, wherein at least said first members are substantially planar and each of said first members are oriented such that a line normal to said plane of said first member is oblique to said axes.

6. A toy as in claim 1, wherein said second rotary element includes a plurality of second elements extending outwardly from said axis and wherein each of said first and second members extends radially outwardly from said axes and is capable of producing said aerodynamic lift upon said rotation.

7. A toy as in claim 6, wherein said members are capable of producing aerodynamic lift substantially parallel to said axes upon rotation of said elements, said lift being produced in opposite directions upon opposite rotation of said elements.

8. A toy as in claim 7, further comprising:

first and second edge guards, one of said edge guards being mounted on an associated one of said elements with said edge guard extending between the radially exterior ends of said members, whereby each of said edge guards forms the exterior periphery of said associated one of said elements.

9. A toy as in claim 8, wherein said edge guards, and therefore said elements, have a circular peripheral configuration.

10. A toy as in claim 9, wherein said elements are formed of plastic.

11. A toy as in claim 10, wherein said elements are differently colored.

12. A toy as in claim 10, wherein there is an even number of both said first and said second members.

13. A toy as in claim 10, wherein the circumferential width of each of said members increases with radial distance from said axes.

14. A toy as in claim 1, wherein said hub is fixed to said elements.

15. A toy as in claim 14, wherein said first end of said line is fixed to said hub.

16. A toy as in claim 14, wherein each of said first members extends radially outwardly from said axes and is capable of producing aerodynamic lift substantially parallel to said axes upon rotation of said elements, said lift being produced in opposite directions upon opposite rotation of said elements.

17. A toy as in claim 16, wherein said second rotary element includes a plurality of second elements extending outwardly from said axis and wherein each of said first and second members extends radially outwardly of said axes and is capable of producing said aerodynamic lift upon said rotation.

18. A toy as in claim 1, wherein said first end of said line is fixed to said hub.

19. A toy as in claim 18, wherein each of said first members extends radially outwardly of said axes and is capable of producing aerodynamic lift substantially parallel to said axes upon rotation of said elements, said lift being produced in opposite directions upon opposite rotation of said elements.

20. A toy as in claim 19, wherein said second rotary element includes a plurality of second elements extending outwardly from said axis and wherein each of said first and second members extends radially outwardly of said axes and is capable of producing said aerodynamic lift upon said rotation.

* * * * *